US005525233A

United States Patent [19]

Falkiner et al.

[11] Patent Number: 5,525,233

[45] Date of Patent: Jun. 11, 1996

[54] PROCESS FOR THE REMOVAL OF ELEMENTAL SULFUR FROM FLUIDS BY MIXING SAID FLUID WITH AN IMMISCIBLE SOLUTION OF ALCOHOLIC CAUSTIC AND AN INORGANIC SULFIDE OR HYDROSULFIDE

[75] Inventors: Robert J. Falkiner, Mississauga; Daniel W. Kraemer, Brights Grove; Marc-Andre Poirier, Sarnia, all of Canada

[73] Assignee: Exxon Research and Engineering Company, Florham Park, N.J.

[21] Appl. No.: 348,512

[22] Filed: Dec. 1, 1994

[51] Int. Cl.[6] ..... C10G 19/04; B01D 11/04

[52] U.S. Cl. ..... 210/638; 210/712; 210/729; 208/230; 208/232

[58] Field of Search ..... 210/634, 638, 210/712, 725, 728, 729, 800; 208/230, 232

[56] References Cited

U.S. PATENT DOCUMENTS

| | | | |
|---|---|---|---|
| 2,538,287 | 1/1951 | Voorhees | 208/232 |
| 2,786,017 | 3/1957 | Brown | 208/232 |
| 3,185,641 | 5/1965 | Cowden | 208/226 |
| 3,804,749 | 4/1974 | Cholet | 208/232 |
| 4,011,882 | 3/1977 | Nivens et al. | 137/15 |
| 4,018,572 | 4/1977 | Swanson | 208/230 |
| 4,149,966 | 4/1979 | O'Donnell et al. | 208/237 |
| 4,248,695 | 2/1981 | Swanson | 208/232 |
| 4,908,122 | 3/1990 | Frame et al. | 208/207 |
| 5,160,045 | 11/1992 | Falkiner et al. | 210/634 |
| 5,199,978 | 4/1993 | Poirier et al. | 208/233 |
| 5,200,062 | 4/1993 | Porier et al. | 208/236 |
| 5,250,181 | 10/1993 | Falkiner et al. | 210/634 |

FOREIGN PATENT DOCUMENTS

| | | | |
|---|---|---|---|
| 055248249 | 11/1989 | U.S.S.R. | 208/230 |

*Primary Examiner*—Peter A. Hruskoci
*Assistant Examiner*—Theodore M. Green
*Attorney, Agent, or Firm*—Joseph J. Allocca

[57] ABSTRACT

A process for removing elemental sulfur from fluids such as refined petroleum products transported through pipelines normally used for the transport of sour hydrocarbon streams. The sulfur containing fluids are mixed with an immiscible aliphatic solution containing an inorganic caustic material, methanol or aqueous alcohol and an inorganic sulfide or hydrosulfide capable of reacting with the elemental sulfur in a mixing zone to form a polysulfide present in the immiscible alcoholic solution, passing the mixture of fluid and immiscible alcoholic solution to a phase separation zone wherein mixture separates into a fluid phase of reduced elemental and total sulfur content and an immiscible alcoholic phase containing polysulfides, recovering the fluid phase of reduced sulfur content from the phase separation zone, recovering the immiscible alcoholic phase containing polysulfide from the phase separation zone and recycling the immiscible alcoholic solution to the mixing zone. Alcohol from the spent immiscible alcoholic solution may be flash-distilled and recycled for reuse in the process.

4 Claims, 2 Drawing Sheets

PROCESS FOR THE REMOVAL OF ELEMENTAL SULFUR FROM FLUIDS BY MIXING SAID FLUID WITH AN IMMISCIBLE SOLUTION OF ALCOHOLIC CAUSTIC AND AN INORGANIC SULFIDE OR HYDROSULFIDE

BACKGROUND OF THE INVENTION

1. Field of the Invention

This invention relates to a process for removing elemental sulfur from fluids, particularly fuels such as gasoline, diesel fuel, jet fuel, transported in a pipeline which is usually used for the transport of sour hydrocarbons. The fluids are contacted with a solution capable of reacting with the elemental sulfur and converting it into polysulfides which can be removed from the fluid.

2. Description of Related Art

It is well known that elemental sulfur and other sulfur compounds contained in hydrocarbon streams is corrosive and damaging to metal equipment, particularly copper and copper alloys. Sulfur and sulfur compounds may be present in varying concentrations in the refined fuels and additional contamination may take place as a consequence of transporting the refined fuel through pipelines containing sulfur contaminants resulting from the transportation of sour hydrocarbon streams such as petroleum crudes. The sulfur has a particularly corrosive effect on equipment such as brass valves, gauges and in-tank fuel pump copper commutators.

Various techniques have been reported for removing elemental sulfur from petroleum products. For example U.S. Pat. No. 4,149,966 discloses a method for removing elemental sulfur from refined hydrocarbon fuels by adding an organo-mercaptan compound and a copper compound capable of forming a soluble complex with said mercaptan and said sulfur and contacting said fuel with an adsorbent material to remove the resulting copper complex and substantially all the elemental sulfur.

U.S. Pat. No. 4,908,122 discloses a process for sweetening a sour hydrocarbon fraction containing mercaptans by contacting the hydrocarbon fraction in the presence of an oxidizing agent with a catalytic composite, ammonium hydroxide and a quaternary ammonium salt other than hydroxide.

U.S. Pat. No. 3,185,641 describes a method for removing elemental sulfur from a liquid hydrocarbon which comprises contacting with solid sodium hydroxide a hydrocarbon stream having dissolved therein at least 7.6 parts by weight of water per part of sulfur contained therein to yield both a hydrocarbon phase and an aqueous phase. The method is claimed to be effective and convenient for treating gasoline containing from trace to more than 25 ppm sulfur employing temperatures as high as about 140° F. (60° C.).

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

U.S. Pat. No. 5,160,045 discloses a process for removing elemental sulfur from fluids such as gasoline, diesel fuel, jet fuel or octane enhancement additives such as ethers (MTBE), which pick up sulfur when transported through pipelines which are otherwise used for the transport of sour hydrocarbon streams. In that patent the sulfur containing fluid is contacted with an aqueous solution containing caustic, sulfide and optionally elemental sulfur to produce an aqueous layer containing metal polysulfides and a clear fluid layer having a reduced elemental sulfur level. Preferably an organo mercaptan is also mixed with the fluid to accelerate the removal of elemental sulfur. This patent also recites that alcohol such as methanol, ethanol, propanol, ethylene glycol, propylene glycol, etc. may be added to the aqueous caustic mixture which is contacted with the fluid to be treated. The amount of alcohol used may vary within wide limits. In the case of methanol the patent recites that from 0 to about 90 volume percent of the water may be replaced with alcohol.

U.S. Pat. No. 5,199,978 discloses a process for removing elemental sulfur from fluids such as gasoline, diesel fuel, jet fuel or octane enhancement additives such as ethers (MTBE) which pick up sulfur when transported through pipelines which are otherwise used for the transport of sour hydrocarbon streams. In that patent the sulfur containing fluids are mixed with an inorganic caustic material, an alkyl alcohol and an organo mercaptan or inorganic sulfide compound capable of reacting with sulfur to form a fluid insoluble polysulfide salt reaction product at ambient reaction temperatures. The treated fluid is then contacted with an adsorbent or filtered to remove the insoluble salt leaving a fluid product of very low residual sulfur content.

U.S. Pat. No. 4,248,695 is directed to a process for desulfurizing a sulfur containing fuel comprising contacting the fuel with a lower primary alkanol solution containing an alkali metal hydrosulfide at a temperature and pressure from ambient up to the critical temperature of the alkanol solvent, the water content of said solution being below that which will cause said hydrosulfide to decompose into $K_2S$ hydroxide, and separating said fuel from said aklanol solution now containing the corresponding high sulfur content alkali metal polysulfide with the proviso that the volume ratio of said alkanol solution to said fuel is determined by the gram mols of sulfur present in the fuel divided by 1½ gram mols of sulfur, when sodium is the alkali metal, times the molecular weight of sodium hydrosulfide divided by the number of grams of sodium hydrosulfide per milliliter of the alkanol solution and the volume ratio of said alkanol solution to said fuel is determined by the gram mols of sulfur present in the fuel divided by 2 gram mols of sulfur, when potassium is the alkali metal, times the molecular weight of potassium hydrosulfide per milliliter of the alkanol solution. The process can further include the step of adding 10% water to said separated alkanol solution when the alcohol is below boiling temperature to separate the alcohol and the polysulfide from the fuel. As an additional step water in an amount of not more than one half of the volume of the alkanol can be added to dissolve the alkali metal polysulfide to form a concentrated solution in water which separates from the fuel.

SUMMARY OF THE INVENTION

The present invention is a process for removing elemental sulfur from organic fluids such as hydrocarbon fuels (e.g., gasoline, diesel, jet), fuel blending components such as octane improvers (ethers such as MTBE), mixtures thereof, liquefied petroleum gas (LPG) solvents, and other petroleum streams transported in pipelines which are otherwise used for the transportation of sour hydrocarbon streams, said process compressing intimately mixing in a mixing/contacting zone the sulfur-containing fluid with an immiscible alcoholic solution of caustic material and an inorganic sulfide or hydrosulfide capable of reacting with sulfur to form an insoluble polysulfide reaction product which is taken up in the immiscible alcoholic caustic solution producing a mixture of organic fluid and immiscible alcoholic caustic solution which is present in the polysulfide, phase separating the mixture of fluid and immiscible alcohol caustic solution, recovering the fluid phase of reduced elemental and total sulfur content as product, and recovering the immiscible alcoholic caustic solution phase for recycling or reprocessing. When the immiscible alcoholic caustic solution phase is spent the solution is reprocessed and the alcohol is recovered from such phase by e.g. flash distillation and the recovered alcohol is combined with fresh caustic and inorganic sulfide or polysulfide and recycled to the process.

DETAILED DESCRIPTION OF THE INVENTION

Figure 1:
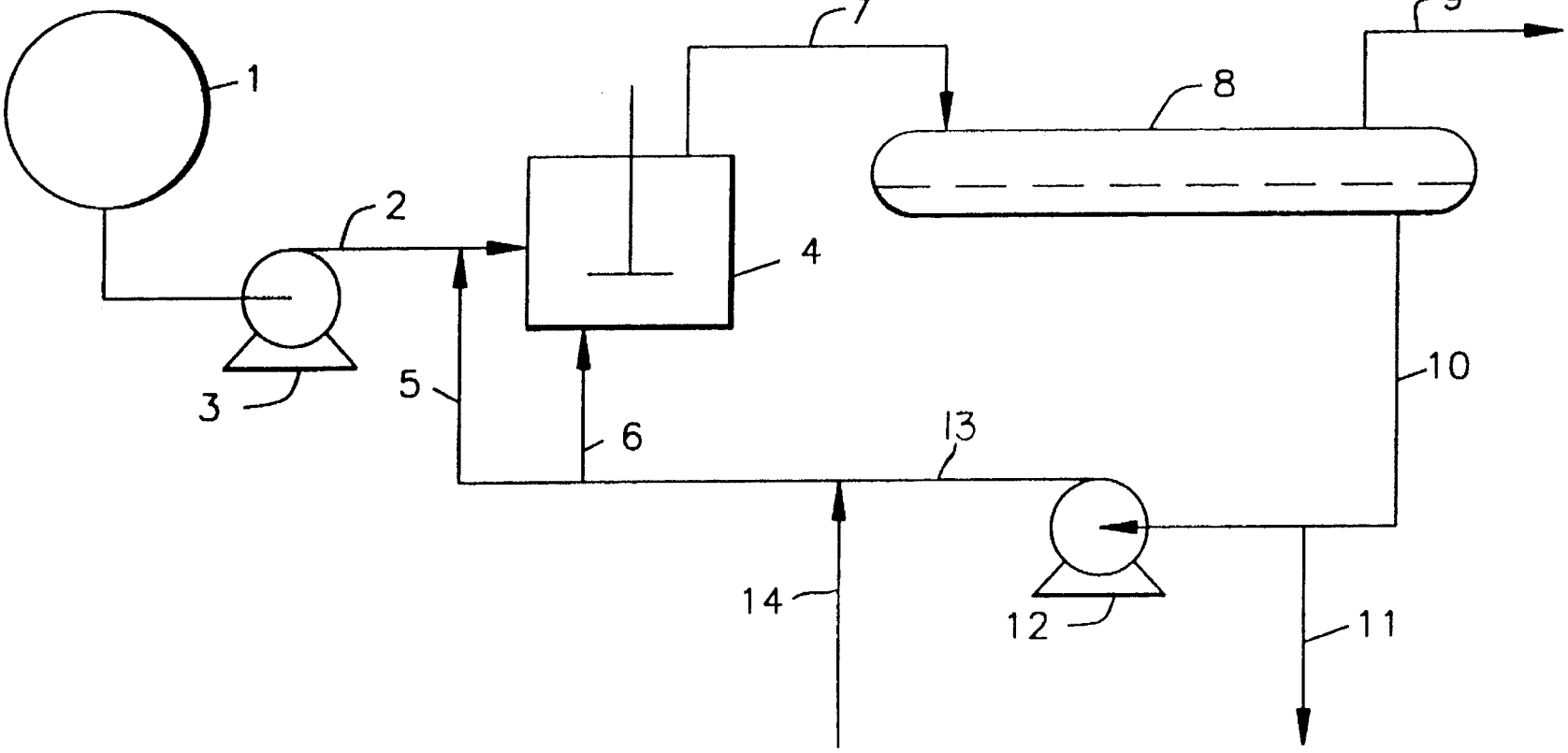
FIG. 1 is a schematic of an embodiment of the present process utilizing co-current or batch contacting a settler.

The fluids which are treated in accordance with the invention include fluids containing elemental sulfur where the elemental sulfur is detrimental to the performance of the fluid. The invention is particularly applicable to those liquid products which have become contaminated with elemental sulfur as a result of being transported in a pipeline previously used to transport sour hydrocarbon streams such as petroleum crudes.

The fluids treated in accordance with the invention include a wide variety of petroleum fuels and particularly refined hydrocarbon fuels such as gasoline, jet fuel, diesel fuel and kerosene.

Other fluids include ethers used to improve the octane ratings of gasoline. These ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, isopropyl tertiary-amyl ether. Mixtures of these ethers and hydrocarbons may also be treated in accordance with the invention.

Still other fluids which can be so treated include liquefied petroleum gas (LPG) and solvents.

The inorganic caustic material which is employed in this invention includes alkali metal or ammonium hydroxides having the formula MOH wherein M is selected from the group consisting of lithium, sodium, potassium, $NH_4$,or mixtures thereof. M is most preferably sodium or potassium. As a a result of the use of the inorganic caustic material, the resultant sulfur products are insoluble in the treated fluids.

The alcohols used in this invention are those which are capable of serving as a dissolving solvent for the caustic, the inorganic sulfide or hydrosulfide and the polysulfide reaction product and are immiscible with the sulfur containing fluids. Methanol or aqueous solutions of $C_1$ to $C_5$ alcohols serve the purpose. The aqueous alcohol solutions used to produce the immiscible alcoholic caustic solutions contain from 1 to 5 vol % water. The $C_1$–$C_5$ alcohols employed can include mono and polyalcohols, e.g. methanol, ethanol, propanol, isopropanol, butanol, isobutanol, test butanol, pentanol, isopentanol, test pentanol, glycols such as ethylene glycol, etc., polyglycols and glycol ethers.

The inorganic sulfide or hydrosulfide include sulfides or hydrosulfides of alkali or alkaline earth metals or ammonia. Examples include $Na_2S$, $K_2S$, $Li_2S$, NaHS, KHS, LiHS, CaS, MgS, $(NH_4)_2S$, $(NH_4)HS$ and combinations thereof. NaHS and KHS are preferred.

In general the process of the invention involves contacting the fluid to be treated in a contacting zone with an immiscible solution containing an effective amount of one or a mixture of inorganic sulfides or hydrosulfides, and caustic dissolved in an alcohol or aqueous alcohol solution with which the fluid to be treated is immiscible to allow for the in-situ formation of a fuel insoluble polysulfide salt which dissolves in the immiscible solution, separating the fluid phase of reduced sulfur content from the immiscible caustic phase containing the dissolved polysulfide salt, recovering the fluid phase of reduced sulfur content as product and recovering the immiscible caustic phase for recycle to the process provided it does not contain so much dissolved polysulfide salt as to be considered spent. In the event it is deemed spent the alcohol can be recovered by flash distillation from the spent immiscible caustic alcoholic solution and independently recycled to the process after being combined with fresh caustic and inorganic sulfide or hydrosulfide.

The treating conditions which may be used to carry out the present invention are conventional. Contacting of the fluid to be treated is effected at ambient temperature conditions, although higher temperatures up to 100° C. or higher may be employed. Substantially atmospheric pressures are suitable, although pressures may, for example, range up to 1000 psig. Contact times may vary widely depending on the fluid to be treated, the amount of elemental sulfur therein and the treating materials used. The contact/mix time will be chosen to effect the desired degree of elemental sulfur removal. In most cases, the reaction proceeds relatively fast, usually within a few minutes. Contact/mix times ranging from 30 seconds to a few hours will usually be adequate.

Contacting/mixing can be accomplished using static mixers, agitated mixers or sonic mixers. The fluid to be treated and the immiscible alcoholic caustic treating solution are contacted concurrently in a contacting zone. It has been discovered and forms the basis of pending application LAW154, U.S. application Ser. No. 348,428 filed Dec. 2, 1994 in the names of Kraemer and Hemrajani that it is preferred when using treat rates of at least about 5% that in mixing the fluid with the caustic solution the caustic solution constitutes the continuous phase. Following contacting the immiscible phases are permitted to phase separate in a suitable separation zone such as a settling tank.

The proportion of methanol or aqueous $C_1$–$C_5$ alcohol solution, caustic and inorganic sulfide or hydrosulfide to be mixed may vary within wide limits. The alcoholic treating solution contains caustic in the range of greater than about 0.2 to 3 M caustic per mole of elemental sulfur present in the fluid to be treated, the sulfide or hydrosulfide concentration ranges from about 0.05 to 2 M, preferably 0.1 to 1 M sulfide or hydro sulfide per mole of elemental sulfur.

Fluids containing quantities of elemental sulfur as high as 100 mg, or higher, sulfur per liter, more usually about 10 to about 60 mg sulfur per liter can be effectively treated in accordance with the invention to reduce the elemental sulfur contamination to about 5 mg sulfur per liter or lower.

The relative amount of immiscible alcoholic caustic solution added to the fluid to be treated will determine if the treated fluid will be clear or hazy due to the fine droplets of treating solution which remain suspended in the fluid and do not easily settle out. If the treated solution is hazy, this would necessitate the practice of additional treatment steps. Thus, the amount of immiscible alcoholic caustic solution used will range from about 0.6 to about 30 vol % of the fluid being treated, preferably about 0.6 to 20 vol %, more preferably 0.6 to 5 vol % of the fluid being treated.

Haziness, however, is not only a function of the amount of treating solution used, but can also be dependent on the intensity of the mixing of the fluid and treating solution. For haziness caused by employing treat rates at the upper end of the recited ranges, coalescers can be used to reduce or eliminate the haze. Coalescers such as those marketed by Pall® Corporation can be used as a settler/separation zone. Coalescers operate on the principle based on the surface tension of the two liquids in contact (the fluid and the immiscible caustic treating solution). Optionally, haziness can be removed by the use of a water wash step. Water can be injected into the hazy treated fluid if taken from the treater prior to the fluid being sent to a settler. Two phases would be produced, a bright and clear treated fluid and an immiscible caustic treating solution. A coalescer would normally not be required if a water washing step is employed.

The process of the present invention will be further described by reference to the two figures which are non-limiting embodiments of the invention.

In FIG. 1, the fluid to be treated, e.g. gasoline from vessel (1) is fed via line (2) through a pump (3) or by gravity feed to a mixer (4). The immiscible alcohol caustic sulfide/hydrosulfide treating solution is added to the fluid to be treated either by introduction via line (5) into line (2) ahead of the mixer (4) or, preferably the immiscible alcohol caustic treating solution is introduced via line (6) into mixer (4). The feed mixed with the immiscible alcoholic caustic treating solution is mixed for a time sufficient to precipitate the elemental sulfur as a polysulfide insoluble in the treated feed but soluble in the immiscible alcoholic caustic solution. The mixture is removed from mixer (4) via line (7) to a liquid/liquid separation vessel such as a settler (8) where the mixture separates into two phases, an upper phase and a lower phase where, depending on the density of the treated fluid, the treated fluid constitutes either the upper or lower phase. In the case wherein the treated fluid is gasoline the upper phase is the treated fluid phase which is drawn off from vessel (8) via line (9) as treated product of reduced sulfur content while immiscible alcoholic caustic containing dissolved polysulfide is drawn off as lower phase via line (10). In the event the caustic solution is spent, i.e., is incapable of further reaction with elemental sulfur to produce polysulfide, the spent immiscible alcoholic caustic solution is drawn off via line (11) for treatment (not shown) such as flash distillation to recover alcohol which can be recycled. If the treatment solution is not spent it can be recycled via pump (12) and line (13) back to the treatment process whereby it is reintroduced into the process via lines (5) and/or (6). Fresh treatment solution can be added either on a continuous basis, or on a batch basis to replace spent treatment to solution, via line (14).

Figure 2:
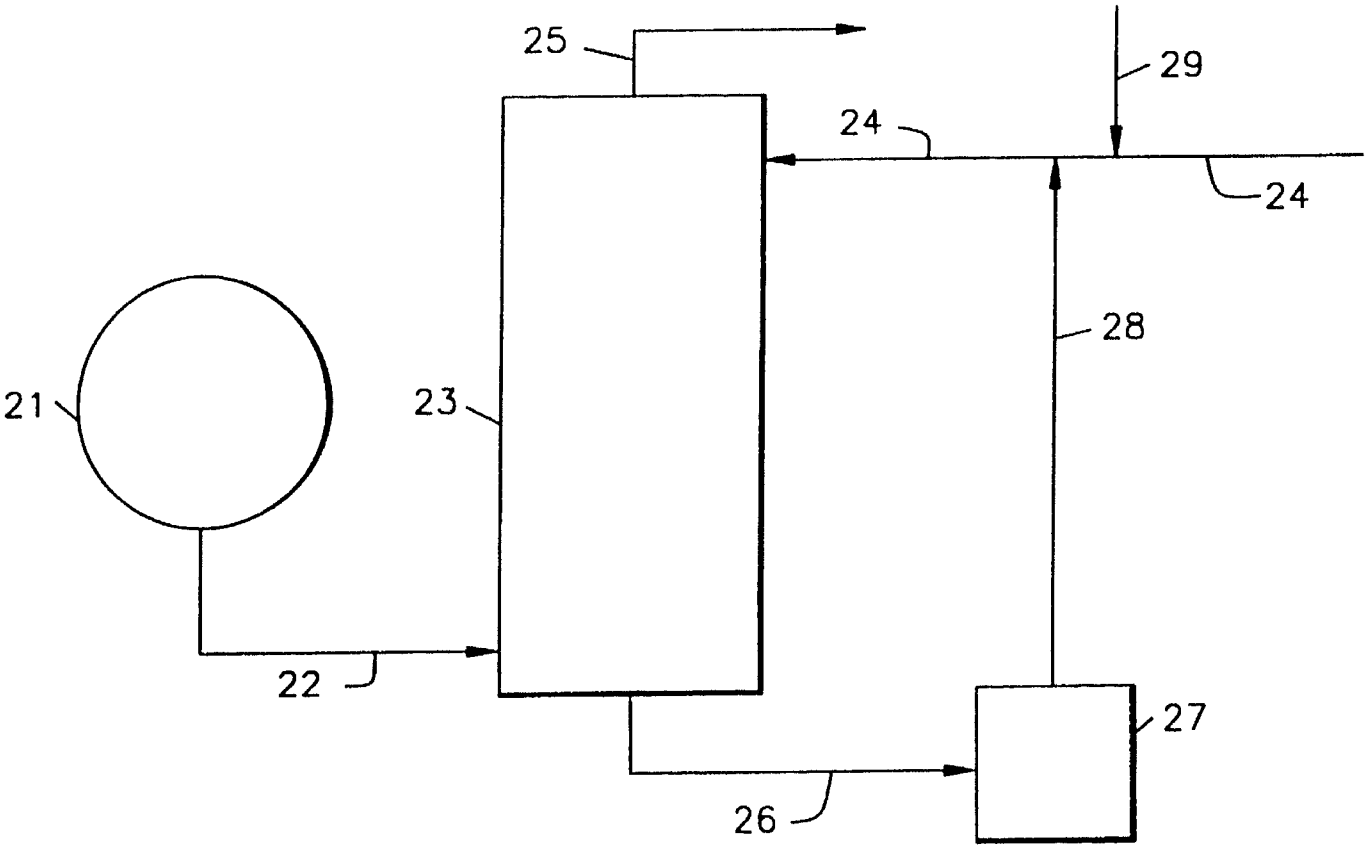
FIG. 2 is a schematic of an embodiment of the present process employing caustic current contacting.

FIG. 2 presents a countercurrent contacting embodiment wherein feed to be treated from tank (21) feed via line (22) into a countercurrent contacting mixer vessel (23). The immiscible alcoholic caustic treatment solution is introduced into the vessel (22) via line (24). The feed is introduced either into the bottom or the top of the contactor depending on the density. If the feed is less dense than the treatment solution (e.g. in the case of gasoline as feed to be treated) it is introduced into the bottom of the vessel, as indicated in the figure. The feed and the treatment solution are countercurrently contacted in vessel (23) and a treated fluid of reduced sulfur content is recovered from the top of vessel (23) via line (25). The immiscible alcohol countercurrent treatment solution containing polysulfides is recovered from the bottom of vessel (23) via line (26). This treatment solution if spent (i.e. if incapable of further conversion of elemental sulfur into polysulfide) is taken via line (26) for treatment (27) such as flash distillation for recovering of alcohol which can be recycled to the process. Immiscible alcoholic caustic, if not spent, is recycled via line (28) back to line (24) for reintroduction into vessel (23). Fresh treatment caustic solution either on a continuous, makeup basis, or on a batch replacement basis (to replace retired, spent solution) can be introduced via line (29).

The process of the present invention is further described by reference to the following non-limiting examples.

The following solutions were prepared.

Solution A: 10 g of sodium hydroxide+5.4 g sodium hydrosulfide ($9H_2O$) were diluted in 100 ml methanol.

Solution B: 10 g of sodium hydroxide in 100 ml methanol.

Solution C: 10 g of sodium hydroxide+5.4 g sodium hydrosulfide ($9H_2O$)+95 ml methanol+5 ml water.

Solution D: 9 g of sodium hydroxide+0.4 g sodium hydrosulfide ($9H_2O$)+95 ml methanol+5 ml water.

Solution E: 9 g of sodium hydroxide+0.4 g sodium hydrosulfide ($9H_2O$)+90 ml methanol+10 ml water.

Solution F: 9 g of sodium hydroxide+0.2 g sodium hydrosulfide ($9H_2O$)+95 ml methanol+5 ml water.

Solution G: 0.5 g sodium hydrosulfide+100 ml methanol.

Solution H: 5 g of sodium hydroxide+0.5 g sodium hydrosulfide ($9H_2O$)+95 ml methanol+5 ml water.

Solution J: 10 g of sodium hydroxide+5.4 g sodium hydrosulfide ($9H_2O$)+100 ml water.

Solution K: 5.4 g sodium hydrosulfide ($9H_2O$) in 100 ml methanol.

The sodium hydrosulfide not totally soluble in the methanol. Solution hazy.

Solution L: 5.4 g sodium hydrosulfide ($9H_2O$)+95 ml methanol+5 ml water. Not totally soluble in the methanol-water mixture. Solution hazy.

Solution M: log sodium hydroxide+5.4 g sodium hydrosulfide ($9H_2O$)+95 ml ethanol+5 ml water. Sodium hydroxide and sodium hydrosulfide partially dissolved.

EXAMPLE 1

100 ml of pipelined gasoline having 37 mg/L elemental sulfur was shaken in an Eberbach Shaker for 5 minutes in the presence of 30 ml Solution A. The elemental sulfur content in the gasoline was reduced to 0.5 mg/L. However, the gasoline was hazy.

EXAMPLE 2

100 ml of pipelined gasoline having 37 mg/L elemental sulfur was shaken in an Eberbach Shaker for 30 minutes in the presence of 0.6 ml of Solution A. The elemental sulfur content in the gasoline was reduced to 0.5 mg/L. The total sulfur was also reduced from 170 mg/L to 140 mg/L., the gasoline was also clear and no haze was produced.

EXAMPLE 3

This example shows that methanolic caustic solution is capable of removing elemental sulfur but not to the same level as the same solution containing sodium hydrosulfide (Solution A).

100 ml of pipelined gasoline having 37 mg/L elemental sulfur was shaken for 5 minutes in the presence of 30 ml Solution B. The elemental sulfur content in the gasoline was reduced to 14 mg/L. The gasoline was also hazy.

EXAMPLE 4

100 ml of pipelined gasoline having 37 mg/L elemental sulfur was shaken in an Eberbach Shaker for 20 minutes in the presence of 0.6 ml of Solution A. The elemental sulfur content in the gasoline was reduced to 1 mg/L. The gasoline was also clear with no haze.

EXAMPLE 5

100 ml of pipelined gasoline having 37 mg/L elemental sulfur was shaken for 30 minutes in the presence of 0.6 ml of Solution C. The elemental sulfur content in the gasoline was reduced to 1 mg/L. The total sulfur was also reduced from 170 mg/L to 140 mg/L. The gasoline was also clear and no haze was produced.

EXAMPLE 6

This example shows that 5% water added to the methanol does not significantly degrade sulfur removal performance of the solution.

100 ml of pipelined gasoline having 37 mg/L elemental sulfur was shaken for 30 minutes in the presence of 0.6 ml of Solution D. The elemental sulfur in the gasoline was reduced to 2 mg/L and the fuel was clear.

EXAMPLE 7

This example shows that addition of 10% water to the methanolic caustic solution significantly degrades the sulfur removal process.

100 ml of pipelined gasoline having 37 mg/L elemental sulfur was shaken for 30 minutes with 0.6 ml of Solution E. The elemental sulfur content in the gasoline was reduced to 20 mg/L. However, the treated gasoline was clear and no haze was produced.

EXAMPLE 8

This example shows that decreasing the sodium hydrosulfide content from 0.4 to 0.2 g/100 ml significantly affected the sulfur removal process.

100 ml of pipelined gasoline having 37 mg/L elemental sulfur was shaken for 30 minutes in the presence of 0.6 ml of Solution F. The elemental sulfur in the gasoline was reduced to 16 mg/L, but no haze was produced.

EXAMPLE 9

This example shows that methanolic solution of sodium hydrosulfide as per U.S. Pat. No. 4,248,695 is not as effective as methanolic caustic solution of this invention.

100 ml of pipelined gasoline having 32 mg/L elemental sulfur was shaken for 30 minutes in the presence of 0.6 ml of Solution G. The elemental sulfur in the gasoline was reduced to 29 mg/L but the gasoline layer was clear.

EXAMPLE 10

This example also shows that the concentration of sodium hydroxide in the solution is important to the sulfur removal performance.

100 ml of pipelined gasoline having 32 mg/L elemental sulfur was shaken for 30 minutes in the presence of 0.6 ml of Solution H. The elemental sulfur was reduced to 12 mg/L.

EXAMPLE 11

98 ml of pipelined gasoline having 32 mg/L elemental sulfur and 2 ml methanol was shaken for 30 minutes in the presence of 30 ml of Solution J. The elemental sulfur content in the gasoline was reduced to 8 mg/L. The gasoline was also clear with no haze.

EXAMPLE 12

100 ml of pipelined gasoline having 30 mg/L elemental sulfur was shaken in an Eberbach Shaker for 30 minutes in the presence of 0.6 ml of Solution K. The elemental sulfur content in the gasoline was reduced to 3 mg/L.

EXAMPLE 13

100 ml of pipelined gasoline having 30 mg/L elemental sulfur was shaken in an Eberbach Shaker for 30 minutes in the presence of 0.6 ml of Solution L. The elemental sulfur content in the gasoline was reduced to 1 mg/L.

EXAMPLE 14

100 ml of pipelined gasoline having 30 mg/L elemental sulfur was shaken in an Eberbach Shaker for 30 minutes in the presence of 0.6 ml of Solution M. The elemental sulfur content in the gasoline was reduced to 10 mg/L.

EXAMPLE 15

100 ml of pipelined gasoline having 30 mg/L elemental sulfur was shaken in an Eberbach Shaker for 30 minutes in the presence of 25 ml Solution A. The elemental sulfur in the gasoline was reduced to 0 mg/L. The gasoline was slightly hazy.

EXAMPLE 16

100 ml of pipelined gasoline having 30 mg/L elemental sulfur was shaken in an Eberbach shaker for 30 minutes in the presence of 20 ml Solution A. The elemental sulfur in the gasoline was reduced to 0 mg/L. The gasoline was slightly hazy.

EXAMPLE 17

100 ml of pipelined gasoline having 30 mg/L elemental sulfur was shaken in an Eberbach Shaker for 30 minutes in the presence of 10 ml Solution A. The elemental sulfur in the gasoline was reduced to 0 mg/L. The gasoline was still slightly hazy.

EXAMPLE 18

100 ml of pipelined gasoline having 30 mg/L elemental sulfur was shaken in an Eberbach Shaker for 30 minutes in the presence of 5 ml Solution A. The elemental sulfur in the gasoline was reduced to 0 mg/L and the gasoline was almost bright and clear.

What is claimed is:

1. A process for removing elemental sulfur from organic fluids comprising intimately mixing in a mixing/contacting zone the elemental sulfur containing organic fluid with an immiscible alcoholic solution of caustic material and an inorganic sulfide or hydrosulfide capable of reacting with elemental sulfur to form an insoluble polysulfide reaction product which is taken up in immiscible alcoholic caustic solution producing a mixture of organic fluid and immiscible alcoholic caustic solution in which is present the polysulfide caustic product, phase separating the mixture of organic fluid and immiscible alcoholic caustic solution, recovering the organic fluid phase of reduced elemental and total sulfur content as product and recovering the immiscible alcoholic caustic solution phase for recycling or reprocessing, wherein immiscible alcoholic caustic solution consists essentially of methanol, caustic and inorganic sulfide or hydrosulfide or comprises an aqueous solution of a $C_1$ to $C_5$ alcohol containing 1 to 5 vol % water, caustic and inorganic sulfide or hydrosulfide, wherein the sulfide or hydrosulfide concentration ranges from about 0.05 to 2M in said solution.

2. The method of claim 1 wherein the immiscible alcoholic caustic solution contains caustic in the range of greater than 0.2 to about 3M caustic per mole of elemental sulfur present in the organic fluid to be treated.

3. The method of claim 1 wherein the amount of immiscible alcoholic caustic solution added to the organic fluid to be treated is in the range of from about 0.6 to about 30 vol % of the organic fluid being treated.

4. The method of claim 1 wherein the organic fluid treated is gasoline, diesel fuel, jet fuel, kerosene, or octane improvers.

* * * * *